US007028883B1

(12) United States Patent
Choi

(10) Patent No.: US 7,028,883 B1
(45) Date of Patent: Apr. 18, 2006

(54) MAIL DELIVERY INDICATOR SYSTEM

(76) Inventor: Kueun Choi, 5 Camelot Dr., P.O. Box 591, Trumbull, CT (US) 06611

( * ) Notice: Subject to any disclaimer, the term of this patent is extended or adjusted under 35 U.S.C. 154(b) by 0 days.

(21) Appl. No.: 10/780,190

(22) Filed: Feb. 17, 2004

(51) Int. Cl.
*A47G 29/12* (2006.01)

(52) U.S. Cl. ..... 232/35; 116/215

(58) Field of Classification Search ..... 232/35, 232/34, 17, 45; 116/215, 173
See application file for complete search history.

(56) References Cited

U.S. PATENT DOCUMENTS

| | | | | | |
|---|---|---|---|---|---|
| 792,133 | A | | 6/1905 | Hunt | |
| 1,292,050 | A | | 1/1919 | Raney | |
| 1,471,364 | A | * | 10/1923 | Schrock | 232/35 |
| 1,521,397 | A | * | 12/1924 | Scott | 232/35 |
| 2,352,975 | A | | 7/1944 | Roe | |
| 2,505,309 | A | * | 4/1950 | Sprick et al. | 232/35 |
| 2,804,262 | A | | 8/1957 | Mancuso | |
| 2,852,185 | A | * | 9/1958 | Stouten | 232/35 |
| 2,988,268 | A | | 6/1961 | Mioduski | |
| 3,602,424 | A | * | 8/1971 | Raulston | 232/35 |
| 3,747,839 | A | | 7/1973 | Morton | |
| 3,960,317 | A | | 6/1976 | Clement | |
| 4,190,193 | A | | 2/1980 | Smith | |
| 4,752,030 | A | | 6/1988 | Witt | |
| 4,756,472 | A | * | 7/1988 | Hammons | 232/35 |
| 4,759,496 | A | | 7/1988 | Swick | |
| 4,811,895 | A | | 3/1989 | Reinebach | |
| 4,821,953 | A | | 4/1989 | Poloha | |
| 4,836,441 | A | | 6/1989 | Crider | |
| 4,986,467 | A | * | 1/1991 | Bibbee | 232/34 |
| 5,004,148 | A | * | 4/1991 | Windrem | 232/35 |
| 5,123,590 | A | | 6/1992 | Teele | |
| 5,660,327 | A | | 8/1997 | Brinkley, Jr. | |
| 5,964,401 | A | | 10/1999 | Thill | |
| 2001/0000108 | A1 | | 4/2001 | Perry | |

* cited by examiner

*Primary Examiner*—William L. Miller

(57) ABSTRACT

A mail delivery indicator system comprises a minimum number of parts, namely, an indicator flagstaff with a flagged end and a weighted end, a sidewall mounting bracket and a latch element. A pivotal bolt attaches the indicator flagstaff to a side wall mounting bracket, which is then attached to a side wall of a mailbox. When the mailbox front door is opened, the latch element releases the flagged end to traverse rotationally backward away from the mailbox front door by the force of gravity associated with the weighted end of the indicator flagstaff. A weight element pivotally attached to the weighted end of the indicator flagstaff controls the traversing motion of the indicator flagstaff to a generally vertical signaling position to display the indicator flag above the mailbox, visible from a variety of directions. One can use one hand to lower the flagged end to the latch element on the mailbox front door to reset the mail delivery indicator system.

2 Claims, 3 Drawing Sheets

MAIL DELIVERY INDICATOR SYSTEM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to postal mailboxes, specifically to mail delivery indicator systems.

2. Prior Art

Waiting for mail to be delivered can often turn into a nerve wracking experience requiring many futile trips to the roadside mailbox. The patent search for the present invention traces as far back as to U.S. Pat. No. 792,133 issued to J. W. Hunt (1905) and also to U.S. Pat. No. 1,292,050 issued to H. W. Raney (1919). In the wake of these early inventions, many U.S. patents have been issued to cover a wide range of inventions that were designed to produce a timely signal when mail is delivered. They can be grouped into the following four broad classifications based on the primary activation mechanism of each invention—gravity activated mechanisms, spring activated mechanisms, leverage activated mechanisms, and electric and electronic activated mechanisms. Because the present invention operates on the principle of gravity, the search and evaluation of the relevant prior art have primarily been directed to the following fourteen prominent inventions that utilize gravity activated mechanisms:

U.S. Pat. No. 2,352,975 to Roe (1944), U.S. Pat. No. 2,804,262 to Mancuso (1957), U.S. Pat. No. 2,988,268 to Mioduski (1961), U.S. Pat. No. 3,747,839 to Morton (1973), U.S. Pat. No. 3,960,317 to Clement (1976), U.S. Pat. No. 4,190,193 to Smith (1980), U.S. Pat. No. 4,752,030 to Witt (1988), U.S. Pat. No. 4,756,472 to Hammons (1988), U.S. Pat. No. 4,759,496 to Swick (1988), U.S. Pat. No. 4,811,895 to Reinebach (1989), U.S. Pat. No. 4,821,953 to Poloha (1989), U.S. Pat. No. 4,836,441 to Crider (1989), U.S. Pat. No. 5,660,327 to Brinkley (1997), and 20010000108 to Perry (2001).

Among the inventions based on the gravity activated mechanisms cited above, U.S. Pat. No. 4,756,472 issued to Hammons, whose abstract is cited below, represents a typical application of the gravity activated mechanism to produce a signal by traversing the flagged end of their indicator arm toward the mailbox front door when the mailbox front door is opened, but any similarity with the present invention quickly ends there because the present invention makes a contrary directional movement of the indicator flag element away from the mailbox front door to indicate that the mail has arrived.

Title: Mail delivery signaling flag

U.S. Pat. No. 4,756,472

Inventors: Hammons; George M. Issued: Jul. 12, 1988

The specification discloses a mail delivery signaling flag for use on a rural mailbox including an elongate indicator arm. The indicator arm has a weighted end and a flagged end and is rotatably mounted to the side of the mailbox. A trigger means holds the indicator arm in a generally horizontal position until the mailbox door is opened, at which time the indicator arm assumes a generally vertical position with the flagged end raised to indicate that a mail carrier has opened the box.

The following two inventions are also noteworthy because they incorporate the movement of a flagstaff away from the mailbox front door, as does the present invention, but utilize spring activated mechanisms.

Title: Mail delivery indicator for a mailbox

U.S. Pat. No. 5,123,590

Inventors: Teele; A. James Issued: Jun. 23, 1992

A mail delivery indicator which may be readily and easily mounted on the standard rural or cluster mailbox to signal when the mail has been delivered by the mail carrier. The mail delivery indicator comprises an elongated rod forming a flagstaff with one of its ends connected to a coiled spring attached by a bracket to the right side of the mailbox. The other end of the flagstaff is provided with a flag member and a latch element. The latch element serves the dual purpose of securing the flag to the flagstaff and engaging a catch element on the mailbox front door to set the flagstaff in its horizontal non-signaling position when the door is closed. When the door is opened by the mail carrier, the latch element releases from the catch element and the coiled spring causes flagstaff to automatically swing to its vertical signaling position. The flag can be rotatably positioned on the flagstaff to permit optimum viewing and is also provided with a specially designed offset portion which clears the catch element as the flagstaff swings upwardly.

Title: Mailbox indicator system

U.S. Pat. No. 5,964,401

Inventors: Thill; Gene R. Issued: Oct. 12, 1999

A mailbox indicator system includes a flag post having a flag attached to the post by a removable collar. The post is further attached to an elbow member by a coil. The elbow member is attachable to a wall of a mailbox. The coil urges the post into a substantially vertical position. A retention assembly is provided for holding the post in a substantially horizontal orientation when in a set position. The retention assembly is attached to the door of the mailbox such that the post disengages the retention assembly when the mailbox door is opened. In an alternate embodiment, the mailbox indicating system includes a spacer to selectively position the post retention assembly in spaced relationship to the mailbox door such that a mailbox protrusion proximate the mailbox door does not interfere with engagement of the post to the post retention assembly. The elbow member is attachable to the mailbox using a bolt and nut holding a pair of rubber washers around a wall of the mailbox. Preferably, a pair of metal washers are positioned around the rubber washers In U.S. Pat. No. 4,756,472 issued to Hammons, a trigger arm is fastened to the front door to hold the weighted end of an elongated indicator arm in a somewhat horizontal non-signaling position when the mailbox front door is closed. When the mail carrier pulls open the mailbox front door, the trigger means releases the weighted end of the indicator arm which is designed to fall downwardly by the gravity force of its weight and the flagged end of the indicator arm is designed to traverse rotationally forward toward the mailbox front door. The forward movement of the flagged end of the elongated indicator arm may startle the mail carrier and may not be desirable for safety reasons.

A backward movement of the flagged end of an elongated indicator rod away from the mail carrier was adopted in U.S.

Pat. No. 5,123,590 issued to Teele and U.S. Pat. No. 5,964,401 issued to Thill. But their inventions rely on a coiled spring action to swing the flagged end of an elongated indicator rod upward as a latch means attached to the mailbox front door releases the flagged end when the mail carrier opens the mailbox front door. The snappy, upward swing action and resulting residual vibration of the flagstaff caused by the coiled spring action may not be pleasing to the mail carrier.

BACKGROUND OF THE INVENTION—OBJECTS AND ADVANTAGES

The present invention provides a user-friendly mail delivery indicator system that overcomes the shortcomings of the previous devices in the same field heretofore discussed by incorporating the following features:

1) The flagged end of the indicator flagstaff traverses backward away from the mailbox front door in a slow, steady motion without any sharp, snappy recoil action nor vibrations when the mail carrier opens the mailbox front door;
2) The indicator flagstaff is flexibly mounted on the pivotal bolt such that its flagged end can be pulled down from its generally vertical signaling position toward the latch element fastened to the mailbox front door by one hand for resetting;
3) The mail delivery indicator system incurs no operating expenses;
4) The mail delivery indicator system comprises a single moving component and is free from service requirements; and
5) The mail delivery indicator system can readily be attached to an existing mailbox already in use.

Further objects and advantages will become apparent from a consideration of the description and drawings included herewith.

SUMMARY

In accordance with the present invention, a mail delivery indicator system comprises an elongated indicator flagstaff with a flagged end and a weighted end, a latch means and a side wall mounting bracket. The purpose of the present invention is to mitigate the undesirable typical features represented by the three inventions cited above by designing the flagged end of the indicator flagstaff to traverse rotationally away from the mailbox front door in a slow, steady motion of the indicator flagstaff to a generally vertical signaling position to display the indicator flag element above the mailbox, visible from a variety of directions, while the weighted end of the indicator flagstaff to drop downwardly by the force of gravity when the mailbox front door is open.

DRAWINGS—FIGURES

DRAWINGS - Reference Numerals

| | | | |
|---|---|---|---|
| 1 | Indicator flag element | 2 | Weight element |
| 3 | Latch element | 4 | Side wall mounting bracket |
| 5 | Mounting sleeve of flag element | 6 | Mailbox |
| 7 | Front door | 8 | Stop pin |
| 9 | Pivotal bolt for flagstaff assembly | 10 | Mounting bolt |
| 11 | Mounting hole | 12 | Mounting hole |
| 13 | Mounting hole | 14 | Indicator flagstaff |
| 15 | Indicator flag stand element | 16 | Flag mounting section |
| 17 | Top end locking screw | 18 | Washer |
| 19 | Pivotal bolt hole on flag stand | 20 | Pivotal bolt hole on bracket |
| 21 | Locknut on pivotal bolt | 22 | Side wall of mailbox |
| 23 | Latch slot | 24 | Decorative spacer |
| 25 | Locknut on mounting bolt | 26 | Rubber washer |
| 27 | S-shaped locking clip | 28 | Plastic washer |
| 29 | Pivotal bolt for weight element | | |

DETAILED DESCRIPTION

Figure 1:
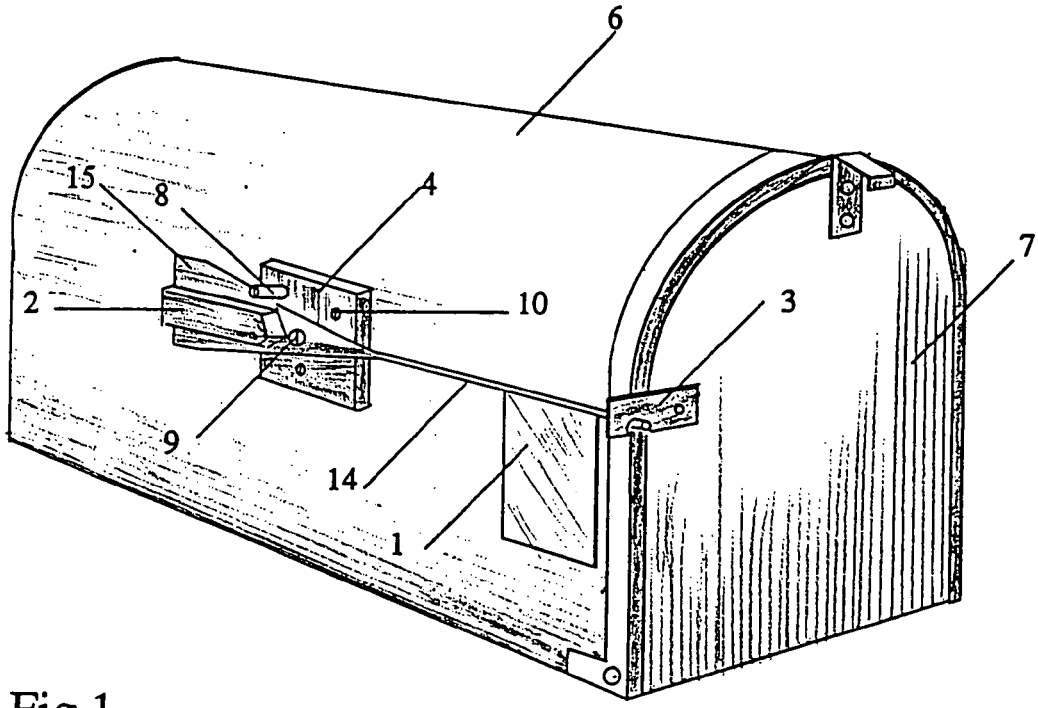
FIG. 1 shows a perspective view of a mailbox with a first embodiment of a mail delivery indicator system attached to the left side wall of the mailbox facing the mailbox front door and showing the indicator flagstaff in a generally horizontal non-signaling position while the mailbox front door is closed.
Figure 2:
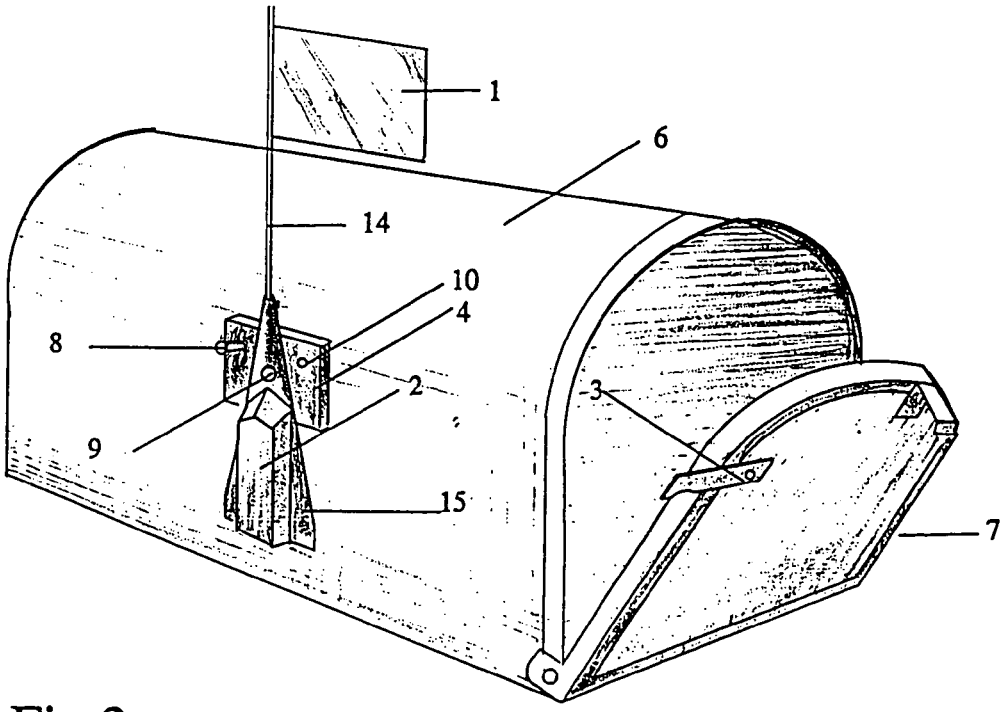
FIG. 2 shows a second perspective view of the mailbox showing the indicator flagstaff in a generally vertical signaling position when the mailbox front door is opened.
Figure 4:
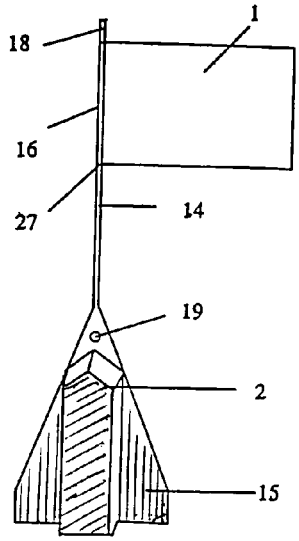
FIG. 4 shows a detailed view of the indicator flagstaff assembly.

A preferred embodiment of a mail delivery indicator system attached to a mailbox 6 is illustrated in FIG. 1 with the indicator flagstaff 14 in a generally horizontal non-signaling position, and in FIG. 2 with the indicator flagstaff 14 disposed in a generally vertical signaling position. In FIG. 4, the indicator flagstaff assembly is shown with a flagged end, a weighted end, an indicator flagstaff 14 and an indicator flag stand element 15.

Figure 3:
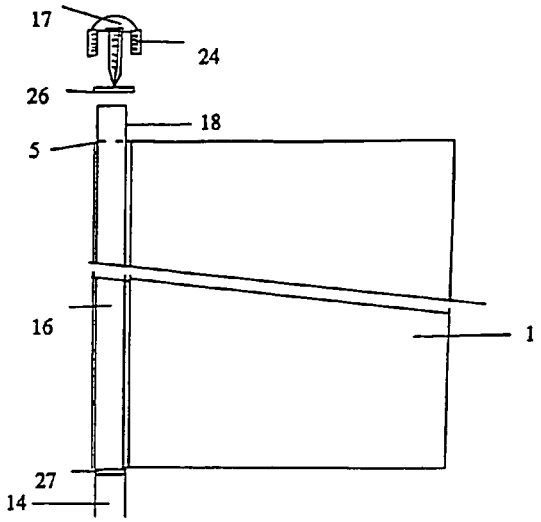
FIG. 3 shows a detailed view of the indicator flag element.

The indicator flag element 1 shown in FIG. 3 is mounted on the top portion of the indicator flagstaff 14. The inner end, the mounting portion, of the indicator flag element 1 has a sleeve attached so that it slides over the top end of the indicator flagstaff 14 until the lower edge of the sleeve 5 engages the S-shaped locking clip 27. The indicator flag element 1 is then held in place by the decorative spacer 24 that is fixed by a top end locking screw 17. The top end locking screw 17 is screwed into the bore of the tubular indicator flagstaff 14, that is preferably being a stainless steel tube of ¼ inch diameter. The indicator flag element 1 may be rotated on the indicator flagstaff 14 to position it at different angles for exposing the maximum amount of its surface area to a selected direction. The indicator flag element 1 may be designed and constructed in a variety of ways appealing to viewers.

The weighted end of the indicator flagstaff 14 in FIG. 4 is an assembly of an indicator flag stand element 15 attached to the indicator flagstaff 14 and a weight element 2. The weight element 2 is fastened to the indicator flag stand element 15 by a screw to permit a ready installation of an appropriate weight for different types and sizes of the indicator flag element 1. The weight element 2 may also be designed and constructed to add an artistic flavor to an otherwise dull mailbox. A hole 19 is formed in the top portion of the indicator flag stand element 15 with the diameter of the hole being slightly greater than the diameter of a pivotal bolt 9 to allow the indicator flagstaff assembly to rotate freely upon the pivotal bolt 9.

Figure 5:
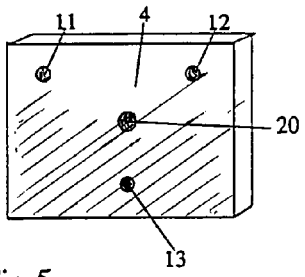
FIG. 5 shows a detailed view of the side wall mounting bracket.

Referring to FIG. 5, a side wall mounting bracket 4 is a square plastic block with an approximate dimension of 2×2×½ inch, and has one hole 20 in the center for the pivotal bolt 9 with a diameter of about ⅜ inch and three additional holes 11, 12, and 13 with a diameter of about ¼ inch. The hole in the upper left corner 11 is to receive a stop pin 8 when the side wall mounting bracket is attached to the left side of the mailbox facing the mailbox front door 7 thereof, and the hole in the upper right corner 12 is for the stop pin 8 when the side wall mounting bracket 4 is installed on the right side of the mailbox.

Figure 6:
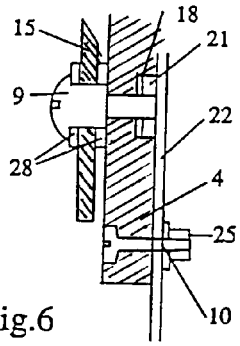
FIG. 6 shows a detailed cross-sectional view of the pivotal connection mechanism of the side wall mounting bracket.

Referring to FIG. 6, the pivotal bolt 9 extends through a washer 28, the pivotal bolt hole 19 of the indicator flag stand element 15 of the indicator flagstaff assembly, another washer 28 and the pivotal bolt hole 20 on the side wall mounting bracket 4. A locknut 21 with integral locknut feature is placed onto the pivotal bolt 9 even with the bottom of the side wall mounting bracket 4 and is tightened sufficiently. The pivotal bolt 9 is preferably a non-corroding bolt, e.g., a stainless steel bolt with an enlarged head, and has a reduced diameter portion with a shoulder to engage the top surface of the side wall mounting bracket 4 to maintain a predetermined gap of 1/16 inch to facilitate a smooth, flexible pivotal movement of the indicator flagstaff assembly and also to allow the top end of the indicator flagstaff 14 to shift laterally to be engaged by the latch element 3 for resetting. A mounting bolt 10 is inserted through the mounting hole 13 and the side wall 22 of the mailbox 6, and is fitted with a washer and a nut inside the mailbox.

Figure 7:
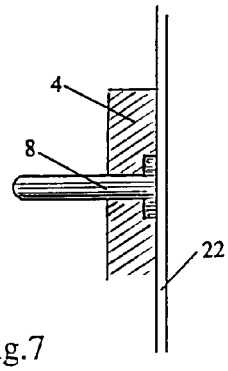
FIG. 7 shows a detailed cross-sectional view of the stop pin of the side wall mounting bracket.

Referring to FIG. 7, a stop pin 8 is installed ½ inch length above the top surface of the side wall mounting bracket 4 to limit the traverse movement of the indicator flagstaff 14 to a generally vertical signaling position. The stop pin 8 extends from the bottom of the side wall mounting bracket through the mounting hole 11 in case of a left side mounting, or through the mounting hole 12 in case of a right side installation.

Figure 8:
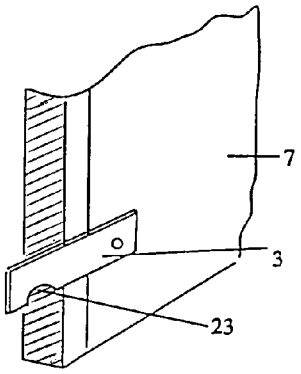
FIG. 8 shows a detailed partial perspective view of a latch element fastened to the mailbox front door.

Referring to FIG. 8, a latch element 3 is firmly attached to the mailbox front door 7 and projects across the edge of the left side wall of the mailbox to keep the indicator flagstaff 14 in a generally horizontal non-signaling position as shown in FIG. 1 when the mailbox front door 7 is closed by holding the top end of the indicator flagstaff 14 in its latch slot 23.

Figure 9:
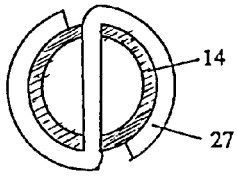
FIG. 9 shows a S-shaped locking clip to hold the indicator flag element in place on the top portion of the indicator flagstaff.

In FIG. 9, a S-shaped locking clip is used to hold the indicator flag element 1 in place on the indicator flagstaff 14. The bottom end of the sleeve 5 of the indicator flag element 1 engages and is supported by the S-shaped locking clip 27 on the indicator flagstaff 14. The S-shaped locking clip 27 may be formed by threading a piece of stainless steel or aluminum wire through the two holes drilled on the tubular indicator flagstaff 14 and bending both ends of the piece of wire around the tubular indicator flagstaff 14 into a letter S shape.

Figure 10:
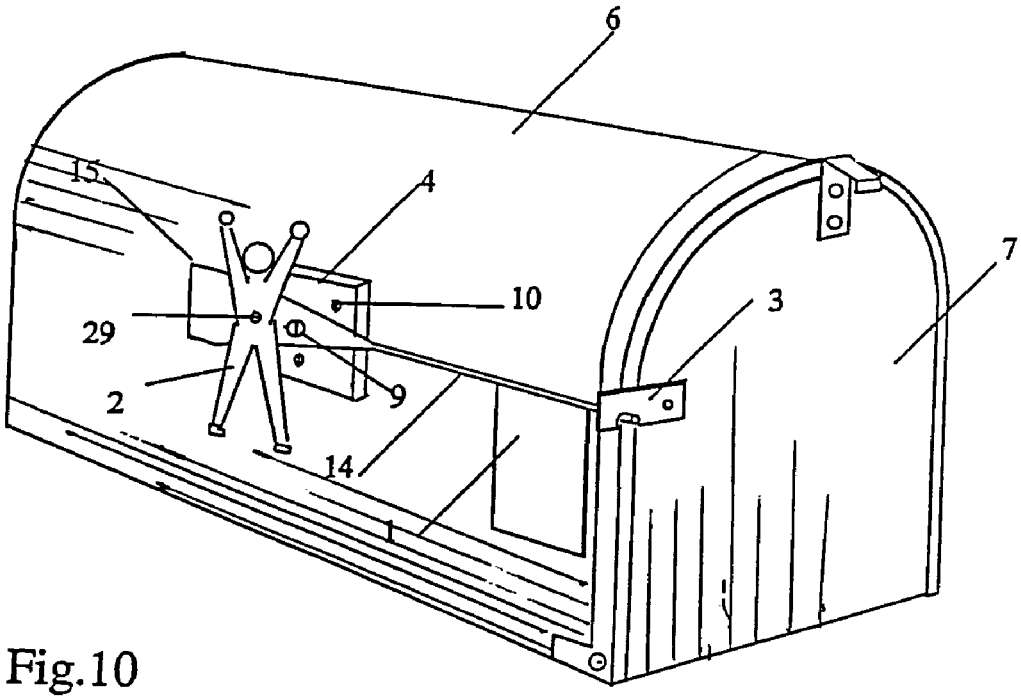
FIG. 10 shows a pivotally mounted weight element on the indicator flag stand element in a correct, upright posture while the indicator flagstaff is in a generally horizontal non-signaling position.
Figure 11:
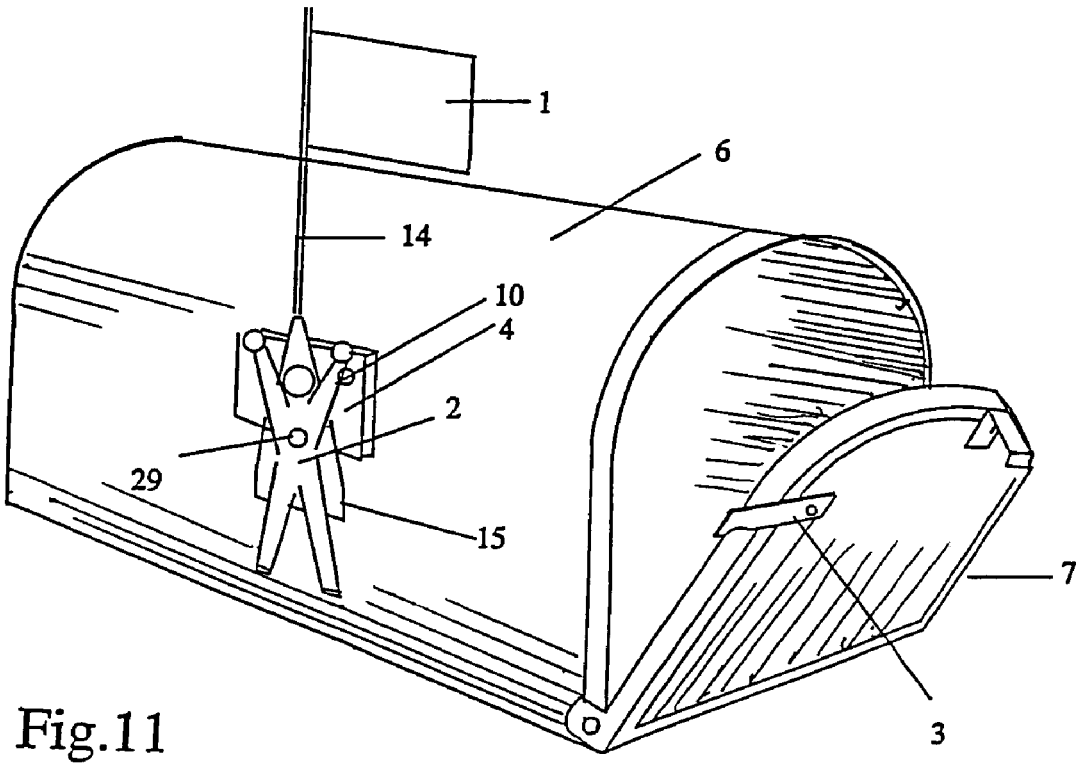
FIG. 11 shows a pivotally mounted weight element on the indicator flag stand element in a correct, upright posture while the indicator flagstaff is in a generally vertical signaling position.

In an alternative embodiment of the weight end assembly, as illustrated in FIG. 10 and FIG. 11, the weight element 2 comprises a figure or shape of an object that possesses normal, distinguishable characteristics for the top and bottom thereof, and is pivotally attached to the indicator flag stand element to assure a correct, normal posture irrespective of the position of the indicator flagstaff element 1. By selecting the pivotal point for the weight element 2 closer to the top end and above the center of gravity thereof, the top end of the weight element will always be disposed above its corresponding bottom end.

While the present invention has been described in terms of preferred embodiments, it is to be understood that nothing in the above description is intended to limit the scope of the claims and it is contemplated that numerous changes and modifications can be made without departing from the spirit and scope of the present invention.

I claim:

1. A mail delivery indicator system designed for a mailbox having side walls and a front door pivotally mounted thereon, comprising:

a) an elongated delivery indicator flagstaff with a flagged end and a weighted end; said elongated delivery indicator flagstaff being maintained in a generally horizontal position when said flagged end engages a latch element on said front door;

b) said elongated delivery indicator flagstaff being pivotally attached to a side wall mounting bracket means, whereby when said front door is opened, said latch element releases said flagged end to traverse rotationally backward away from said front door to a generally vertical signaling position by the force of gravity associated with said weighted end;

c) said weighted end comprises an indicator flag stand element and a weight element;

d) said weight element being pivotally attached at a pivotal point to said indicator flag stand element of said elongated delivery indicator flagstaff; and e) said pivotal point for said weight element being positioned above the center of gravity of said weight element to always display a correct, upright posture of said weight element.

2. The mail delivery indicator system of claim 1 wherein the traversing motion of said elongated delivery indicator flagstaff to the generally vertical signaling position is controlled by the location of said pivotal point of said weight element on said indicator flag stand element.

* * * * *